US005816684A

United States Patent [19]

Yu

[11] Patent Number: 5,816,684

[45] Date of Patent: Oct. 6, 1998

[54] POSITIONABLE FLASHLIGHT AND HOLDER

[76] Inventor: Sun Yu, 2850 Coolidge Hwy., Berkley, Mich. 48072

[21] Appl. No.: 748,502

[22] Filed: Nov. 8, 1996

Related U.S. Application Data

[60] Provisional application No. 60/006,450 Nov. 13, 1995.

[51] Int. Cl.[6] ..... F21L 7/00

[52] U.S. Cl. ..... 362/191

[58] Field of Search ..... 362/190, 191

[56] References Cited

U.S. PATENT DOCUMENTS

| | | | |
|---|---|---|---|
| 1,237,191 | 8/1917 | Friend . | |
| 2,726,321 | 12/1955 | Riotto | 240/10.6 |
| 2,972,739 | 2/1961 | Opper | 340/321 |
| 3,471,849 | 10/1969 | Cheng | 340/321 |
| 4,135,691 | 1/1979 | Weismann | 248/188.6 |
| 4,208,703 | 6/1980 | Orr | 362/287 |
| 4,376,965 | 3/1983 | Bacevius | 362/191 |
| 4,528,622 | 7/1985 | Bacevius | 362/396 |
| 5,103,384 | 4/1992 | Drohan | 362/191 |

OTHER PUBLICATIONS

Radio Shack Cat. No. 61–2742, Handy 3–in–1 Fluorescent Lamp & Spotlight (No Date).

Eveready Tilt Base flashlight product cover (No Date).

*Primary Examiner*—Carroll B. Dority

*Attorney, Agent, or Firm*—Gifford, Krass, Groh, Sprinkle, Patmore, Anderson & Citkowski, P.C.

[57] ABSTRACT

A positionably supportable flashlight includes a flashlight body pivotably attached to a support leg having a first end and a second end which is free, and further including a cross-brace pivotably attached to the support leg so that the cross-brace is movable between a storage position wherein the cross-brace overlies a portion of the support leg to a support position wherein the cross-brace and support leg form an angle therebetween having its vertex at the attachment point. Alternate embodiments include providing an attachment member disposed between the flashlight body and support leg, the flashlight body being removably attached to the attachment member.

11 Claims, 3 Drawing Sheets

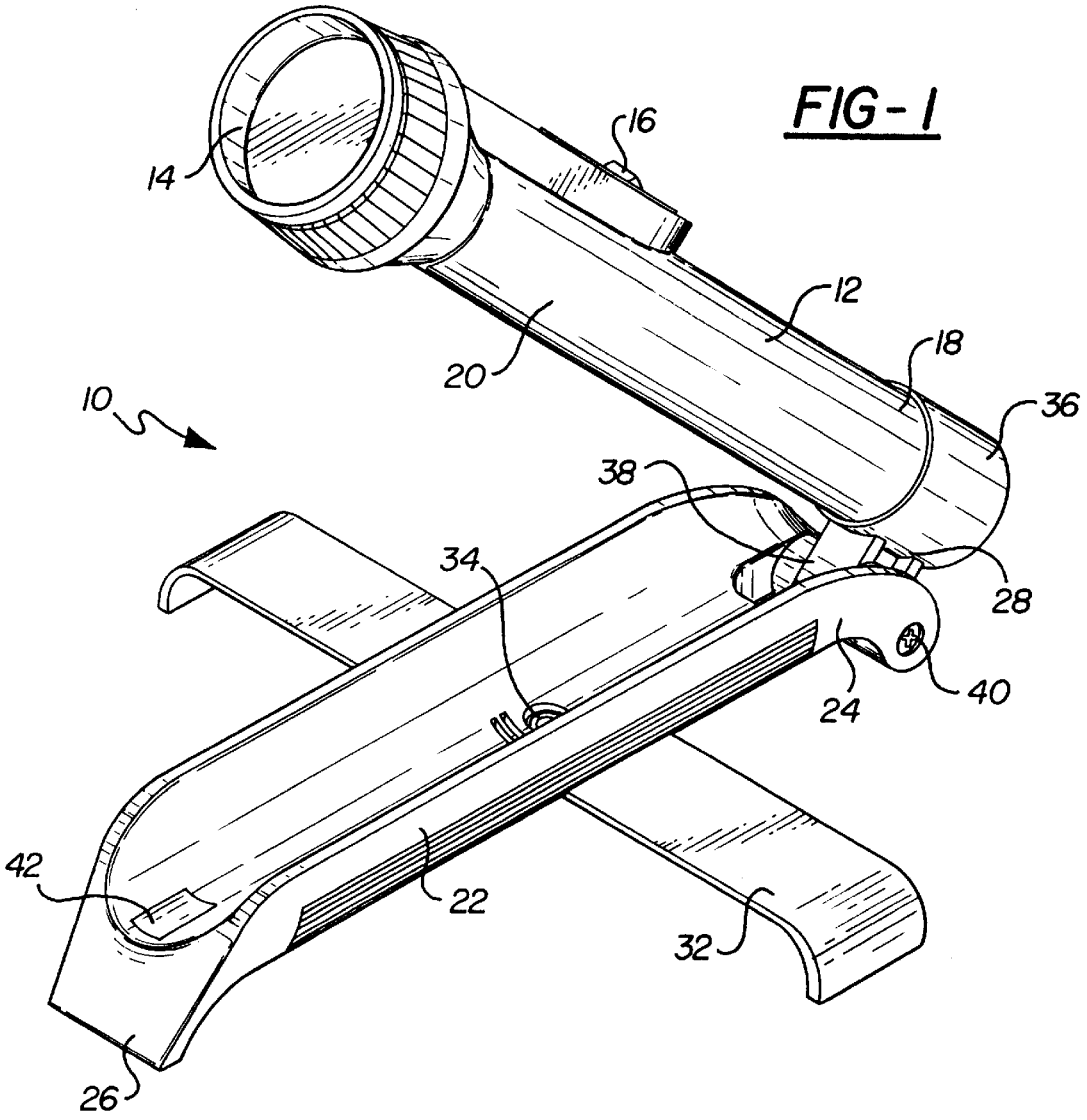
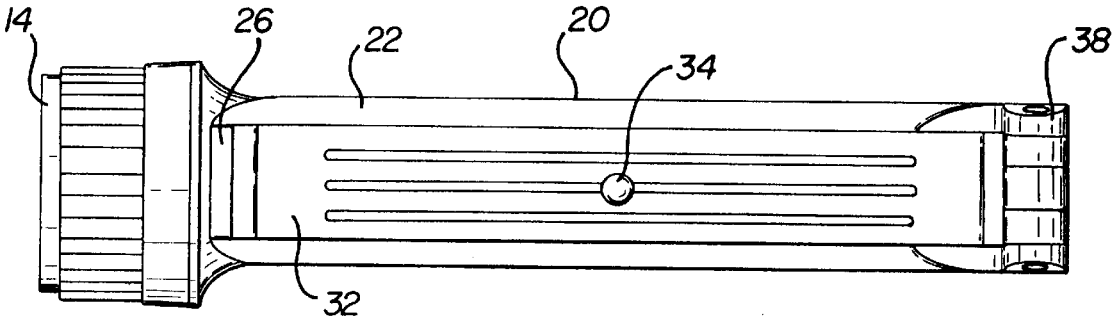
FIG-2

POSITIONABLE FLASHLIGHT AND HOLDER

This application claims the benefit of U.S. Provisional application Ser. No. 60/006,450 filed on Nov. 13, 1995.

FIELD OF THE INVENTION

This invention relates generally to flashlights, and more particularly to a positionable flashlight having an articulated support leg and cross-brace.

BACKGROUND OF THE INVENTION

Portable lights such as flashlights are of great use in a variety of applications, although in some instances, the flashlight must be supported on a surface which is rough and uneven. While a variety of devices are available which enable a flashlight to be positioned such that the light source contained within the flashlight directs light into the desired area, these devices are unnecessarily complex and bulky. There remains a need for an uncomplicated flashlight which is positionable on a rough and/or uneven surface which stores compactly and neatly for use in a hand-held manner.

U.S. Pat. No. 2,972,739 to Opper discloses a portable safety light which has a pivotable easel attached to the central portion of the flashlight body which permits the flashlight to be inclined at a particular angle. U.S. Pat. No. 1,237,191 to Friend similarly discloses a flashlight body having a pivotable support attached to its central portion wherein the flashlight may be positioned at a particular angle with respect to the stand so that light is shone in a particular area. U.S. Pat. No. 2,762,321 to Riotto also discloses a flashlight having a pivotable leg member attached to the flashlight body proximate to the light source so that the flashlight may be fixed in an angle relative to the ground. Each of these devices utilizes a single pivoting leg member to position the flashlight relative to a horizontal surface. While this may effectively position a flashlight on a smooth surface, none of these devices enable a flashlight to be positioned on a rough and/or uneven surface such as the ground.

U.S. Pat. No. 4,376,965 to Bacevius discloses a flashlight holder which may be attached to the edge of a shelf or the like so as to enable a flashlight received within the holder to be positioned in a variety of angles relative to the shelf. The Bacevius device does not enable a flashlight to be positionable upon a rough and/or uneven surface such as the ground.

U.S. Pat. No. 4,208,703 to Orr discloses a flashlight having mounted at one end of the flashlight body three articulated legs controlled by a cam means. The legs are simultaneously moved between a first position proximate to the body of the flashlight to a second position wherein the three articulated legs form a tripod upon which the flashlight is supported. While this configuration does provide for a stable support for a flashlight in many circumstances, it is unnecessarily complex.

Thus, there remains a need in the art for a simple, reliable support for a flashlight which enables the flashlight to be positioned on a rough and/or uneven surface permitting accurate aiming of the emitted light, the support being compactly positionable against the flashlight body.

SUMMARY OF THE INVENTION

The present invention improves upon existing flashlight holding arrangements by providing an elongated support leg having a first and second end, the second end of the support leg being free. Means for pivotably attaching the first end of the support leg to the flashlight body at an attachment point are provided so that the support leg is movable between a first position in which the support leg overlies a portion of the flashlight body to a second position in which the support leg and the flashlight body define an angle therebetween, the vertex of the angle being the attachment point. A cross-brace is pivotably attached to the support leg at a second attachment point defined upon the support leg. The crossbrace is movable from a storage position wherein the cross-brace overlies a portion of the support leg to a support position wherein the cross-brace and the support leg form a second angle therebetween having its vertex at the second attachment point. This leg configuration may be attached directly to the body of the flashlight or to an attachment member such as a cup configured to removably receive the flashlight body.

Other objects, advantages and applications of the present invention will be made clear by the following detailed description of a preferred embodiment of the invention. The description makes reference to drawings in which:

DESCRIPTION OF THE DRAWINGS

FIG. 1 is a perspective view of a preferred embodiment of the present invention;

FIG. 2 is a bottom view of the embodiment depicted in FIG. 1 in its closed state;

DETAILED DESCRIPTION OF THE INTENTION

Figure 3:
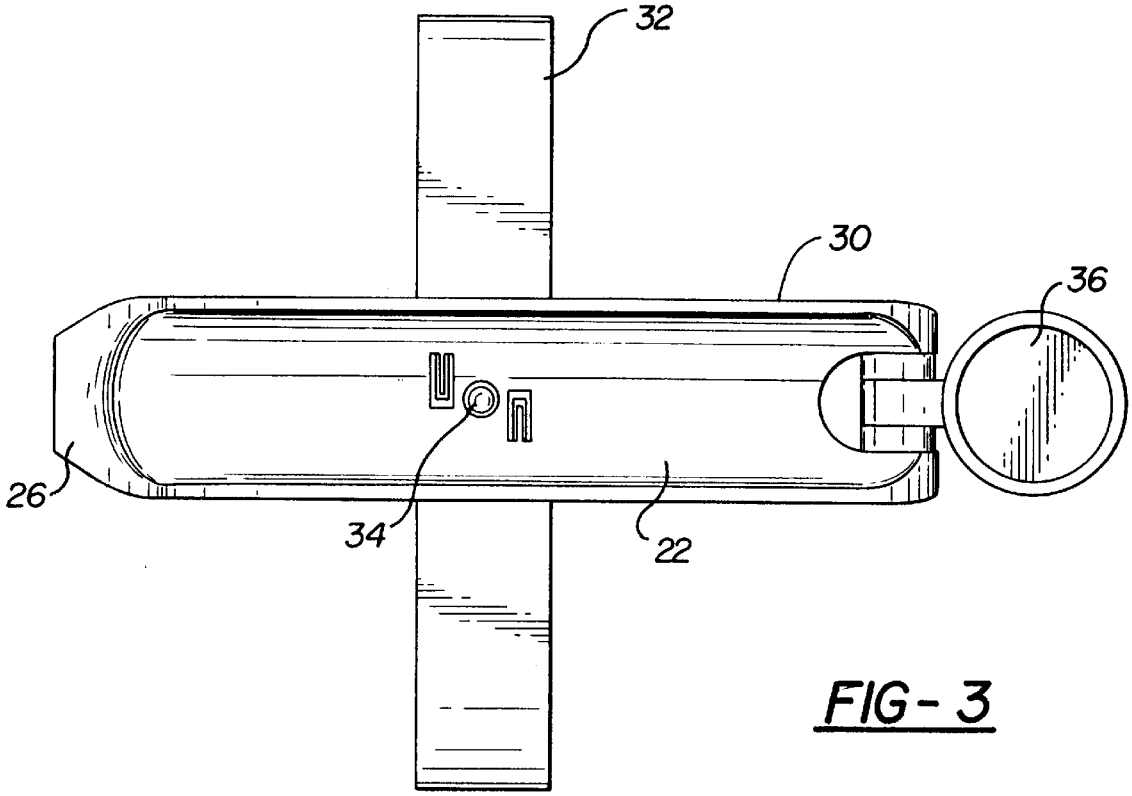
FIG. 3 is a top view of an alternate embodiment of the invention.

An embodiment of the invention, shown generally at 10 in FIG. 1, includes a flashlight body 12 including a front end 14 and a light source (not shown) disposed within the flashlight body 12 so as to project light through the front end 14 when such light is actuated by switch 16 which is in electrical communication with a power source (not shown) and the light source. The flashlight body also includes a second end 18 and a central portion 20. In the preferred embodiment, the flashlight body is generally cylindrical in shape, although alternate embodiments may include flashlights having various configurations such as quadrilateral or triangular.

Figure 4A:
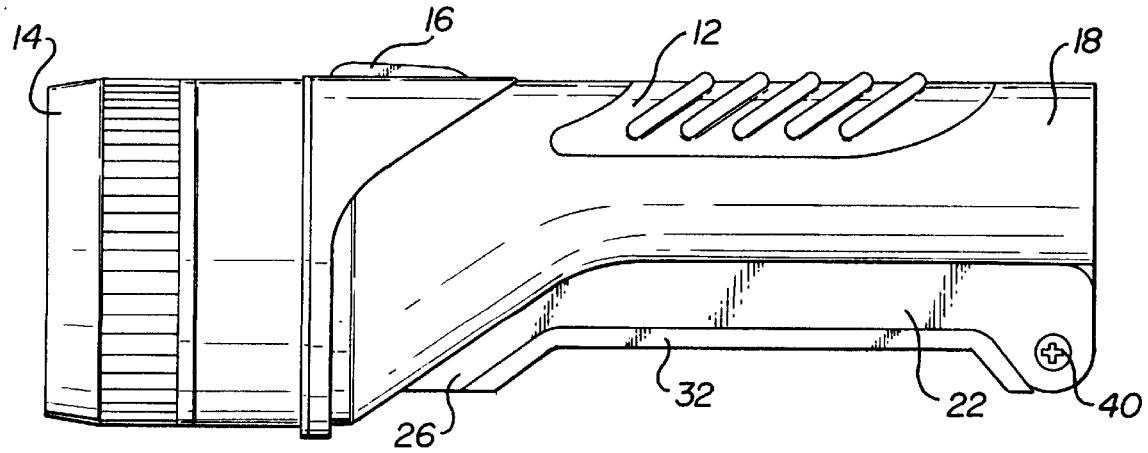
FIG. 4A is a side view of another embodiment of the present invention in its closed state.
Figure 4B:
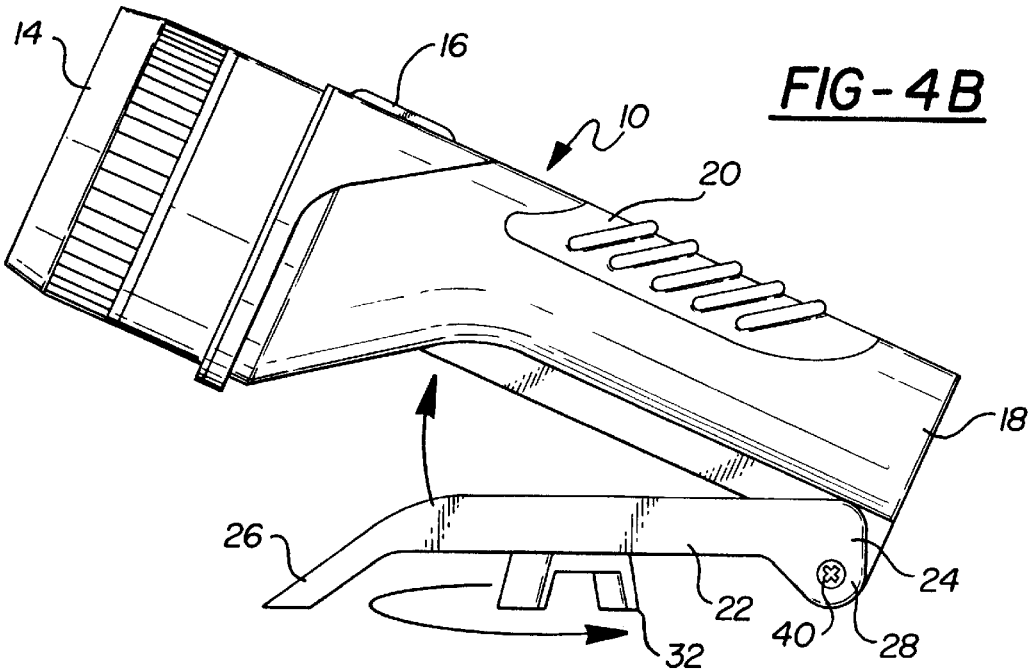
FIG. 4B is a side view of the embodiment depicted in 4A illustrating the movement of the support leg and cross-brace.

As best shown in FIGS. 4A and 4B, an elongated support leg 22 has a first end 24 which is pivotably attached to the flashlight body 12 proximate to end 18 at attachment point 28. A second end 26 of support leg 22 is a free end. In the embodiment depicted in FIGS. 1, 2 and 3, an attachment member 36 is disposed between the second end 18 of flashlight body 12 and end 24. In the embodiment depicted in FIG. 4B, support leg 22 may be attached to the flashlight body 12 directly, rather than through an attachment member 36. Support leg 22 is pivotable between a first position shown in FIG. 2, wherein support leg 22 overlies the central portion 20 of the flashlight body 12 to a second position, depicted in FIG. 1, wherein the second end 26 is spaced apart from the flashlight body 12. In this second position, support leg 22 and flashlight body 12 define an angle which has its vertex at attachment point 28.

In the preferred embodiment, support leg is configured to be complementary to the shape of the flashlight body 12 so that, when support leg 22 is in its first position, it conforms to the shape of flashlight body 12 so as to enable a user to grip the flashlight and support leg in its second position comfortably and conveniently. Other means to pivotably attach the flashlight body to the support leg may be utilized in addition to pivot assembly 38 shown in FIG. 1, such as ratcheting means or cam arrangements.

Figure 5:
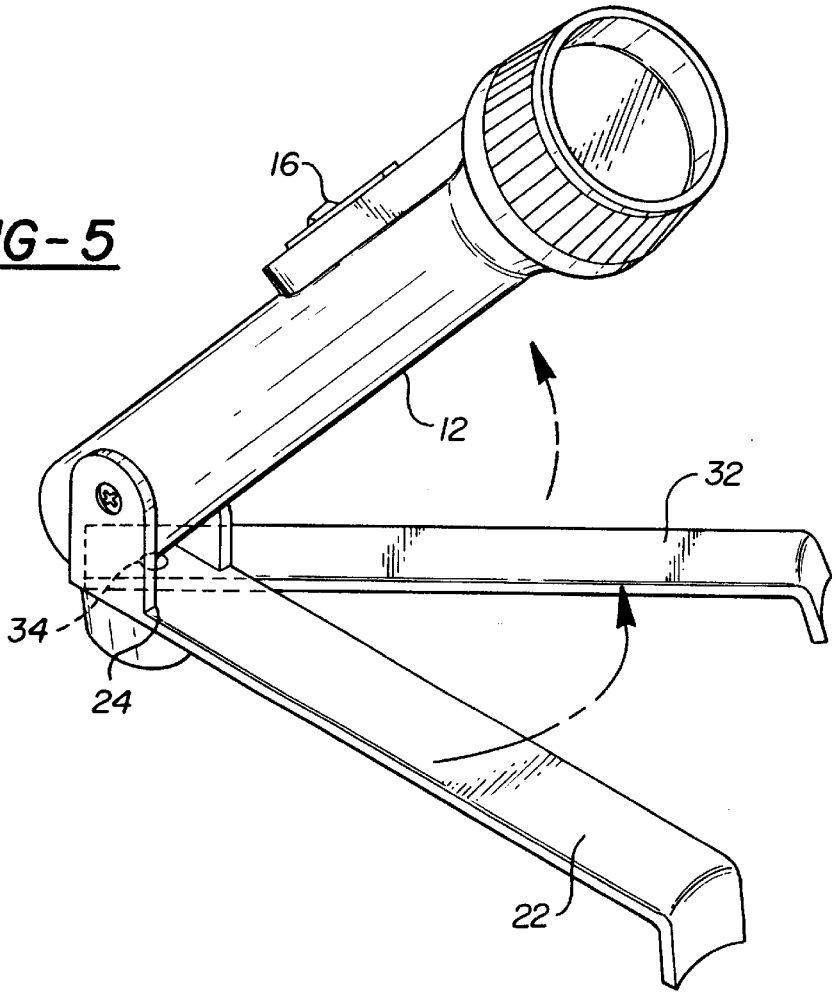
FIG. 5 is a perspective view of another embodiment of the present invention.

A cross-brace 32 is pivotably attached to the support leg 22 at second attachment point 34, which is defined upon support leg 22. Cross-brace 32 is movable between a storage position, shown in FIGS. 2 and 4A, wherein cross-brace 32 overlies a portion of support leg 22 to an extended position, shown in FIGS. 1, 3, 4B and 5, wherein cross-brace 32 and support leg 22 form a second angle therebetween having its vertex at second attachment point 34. In the embodiment depicted in FIG. 5, cross-brace 32 is pivotably attached to support leg 22 proximate to its first end 24. Cross-brace 32 and support leg 22 act together to provide a stable and adaptable support for flashlight body 12 so that light emitted through end 14 may be directed at the necessary area.

A positionably supportable holder for a flashlight body is depicted in FIG. 3 wherein attachment member 36 is configured to receive flashlight body 12, but is not permanently attached to flashlight body 12. Attachment member 36 is substantially cup-shaped, although alternate embodiments may include attachment members which are configured otherwise, such as a Velcro strap, gripping jaws or other clamping means. The embodiment depicted in FIG. 1 shows a cup-shaped attachment member which may be fixedly attached to end 18 of flashlight body 12.

Alternate embodiments may also include a magnet 42 positioned in support leg 22 so that, as support leg 22 is positioned proximate to the flashlight body 12 (which has a magnetically-attractive casing or attachment point), magnet 42 assists in retaining support leg 22 in its storage position or first position proximate to flashlight body 12.

Thus, the present invention provides a flashlight which is comfortable for hand-held use as well as providing a flexible yet stable support system for the flashlight so that the flashlight is able to shine light in the required work areas on whatever surface is desired.

Having described the various embodiments of the present invention with reference to the accompanying figures, it will be appreciated that various changes and modifications can be made without departing from the scope or spirit of the invention.

I claim:

1. A positionably supportable flashlight assembly comprising:

a flashlight body including a front end and a light source disposed therein which projects light through the front end;

an elongated support leg having a first end, a second end which is a free end;

means for pivotably attaching the first end of the support leg to the flashlight body at an attachment point, the support leg being movable from a first position in which the support leg overlies a portion of the flashlight body to a second position in which the second end is spaced apart from the flashlight body so that the support leg and flashlight body define a first angle therebetween having its vertex at the attachment point; and a cross-brace pivotably attached to the support leg at a second attachment point defined upon the support leg, the cross-brace movable from a storage position wherein the cross-brace overlies a portion of the support leg to a support position wherein the cross-brace and support leg form a second angle therebetween having its vertex at the second attachment point.

2. The flashlight of claim 1 wherein the means for pivotably attaching includes an attachment member configured to engage the flashlight body.

3. The flashlight of claim 2 wherein the flashlight body is cylindrical and the attachment member is cup-shaped.

4. The flashlight of claim 1 wherein the means for pivotably attaching includes a pivot pin.

5. The flashlight of claim 1 wherein the second attachment point is between the first and second end of the support leg.

6. The flashlight of claim 1 wherein the flashlight body is cylindrical and the cross-section of the support leg is curved in a direction transverse to its length to correspond to the circumference of the flashlight body.

7. The flashlight of claim 1 wherein the support leg includes a magnet.

8. A positionably supportable holder for a flashlight body including a front end and a light source disposed therein which projects light through the front end, the holder comprising:

an attachment member configured to engage the flashlight body;

an elongated support leg having a first end, a second end which is a free end;

means for pivotably attaching the first end of the support leg to the attachment member at an attachment point, the support leg being movable from a first position in which the support leg overlies a portion of the attachment member to a second position in which the second end is spaced apart from the attachment member so that the support leg and attachment member define a first angle therebetween having its vertex at the attachment point; and a cross-brace pivotably attached to the support leg at a second attachment point defined upon the support leg, the cross-brace movable from a storage position wherein the cross-brace overlies a portion of the support leg to a support position wherein the cross-brace and support leg form a second angle therebetween having its vertex at the second attachment point.

9. The holder of claim 8 wherein the attachment member is substantially cup-shaped.

10. The holder of claim 8 wherein the second attachment point is between the first and second end of the support leg.

11. The holder of claim 8 wherein the means for pivotably attaching includes a pivot pin.

* * * * *